US008021104B2

(12) United States Patent
Gu et al.

(10) Patent No.: US 8,021,104 B2
(45) Date of Patent: Sep. 20, 2011

(54) COMPRESSOR APPARATUS WITH RECIRCULATION AND METHOD THEREFORE

(75) Inventors: Ronglei Gu, Saitama (JP); Shinichiro Ohkubo, Kodama-machi (JP); Atsushi Ishii, Chiba (JP)

(73) Assignee: Honeywell International Inc., Morristown, NJ (US)

( * ) Notice: Subject to any disclaimer, the term of this patent is extended or adjusted under 35 U.S.C. 154(b) by 1141 days.

(21) Appl. No.: 11/628,610

(22) PCT Filed: Jun. 7, 2004

(86) PCT No.: PCT/US2004/017866

§ 371 (c)(1),
(2), (4) Date: Jun. 5, 2007

(87) PCT Pub. No.: WO2005/121560

PCT Pub. Date: Dec. 22, 2005

(65) Prior Publication Data

US 2007/0224032 A1 Sep. 27, 2007

(51) Int. Cl.
*F04D 29/66* (2006.01)

(52) U.S. Cl. ..... 415/56.5; 415/58.4

(58) Field of Classification Search ..... 415/52.1, 415/56.5, 58.4, 58.5, 144

See application file for complete search history.

(56) References Cited

U.S. PATENT DOCUMENTS

| | | | | |
|---|---|---|---|---|
| 5,246,335 | A * | 9/1993 | Mitsubori et al. | 415/58.3 |
| 6,447,241 | B2 * | 9/2002 | Nakao | 415/1 |
| 6,726,441 | B2 * | 4/2004 | Sumser et al. | 415/56.5 |
| 7,775,759 | B2 * | 8/2010 | Sirakov et al. | 415/1 |

FOREIGN PATENT DOCUMENTS

| | | | |
|---|---|---|---|
| JP | 2003314496 | A * | 11/2003 |
| WO | WO 2005068842 | A1 * | 7/2005 |

OTHER PUBLICATIONS

PCT ISR/WO Honeywell Inc.

* cited by examiner

*Primary Examiner* — Edward Look
*Assistant Examiner* — Ryan H Ellis
(74) *Attorney, Agent, or Firm* — Alston & Bird LLP

(57) ABSTRACT

There is provided a compressor (10) and associated method for providing a flow of recirculated air to control surging in the compressor. The compressor includes a housing (12) with a compressor wheel (16) rotably mounted therein. The housing defines at least one injection port (36) configured to receive compressed air from the compressor wheel and recirculate the compressed air to an inlet passage (20) of the compressor. In particular, each injection port defines an outlet (38) proximate to the leading edges (32) of the blades (18) of the compressor wheel such that the compressed air is delivered to the leading edges and reduces the occurence of surging.

23 Claims, 7 Drawing Sheets

COMPRESSOR APPARATUS WITH RECIRCULATION AND METHOD THEREFORE

FIELD OF THE INVENTION

The present invention relates generally to compressor systems, such as a compressor for use in a turbocharger for an internal combustion engine, and more particularly relates to recirculation in such a compressor to prevent or reduce the occurrence of surging.

BACKGROUND OF THE INVENTION

Turbochargers are typically used to increase the power output of an internal combustion engine such as in an automobile or other vehicle. A conventional turbocharger includes a turbine and a compressor. The turbine is rotatably driven by the exhaust gas from the engine. A shaft connects the turbine to the compressor and thereby rotates the compressor. As the compressor rotates, it compresses air that is then delivered to the engine as intake air. The increase in pressure of the intake air increases the power output of the engine. In a typical turbocharger for an internal combustion engine of an automobile, the compressor is a centrifugal compressor, i.e., air enters the compressor in a generally axial direction and exits the compressor in a generally radial direction.

Compressor surge refers to a generally undesirable operating condition in which the flow begins to separate on the compressor blades because of excessive incidence angle. Surge typically occurs when the compressor is operated with a relatively high pressure ratio and with low flow therethrough. For example, compressor surge can occur when the engine is operating at high load or torque and low engine speed, or when the engine is operating at a low engine speed with a high rate of exhaust gas recirculation from the engine exhaust side to the intake side. Compressor surge can also occur when a relatively high specific power output, e.g., more than about 70 to 80 kilowatts per liter, is required of an engine with an electrically assisted turbocharger. Additionally, surge can occur when a quick compressor response is required using an electrically assisted turbocharger and/or variable nozzle turbine (VNT) turbocharger, or when the engine is suddenly decelerated, e.g., if the throttle valve is closed while shifting between gears.

As a result of any of the foregoing operating conditions, the compressor can surge as the axial component of absolute flow velocity entering the compressor is low in comparison to the blade tip speed in the tangential direction, thus resulting in the blades of the compressor operating at a high incidence angle, which leads to flow separation and/or stalling of the blades. Compressor surge can cause severe aerodynamic fluctuation in the compressor, increase the noise of the compressor, and reduce the efficiency of the compressor. In some cases, compressor surge can result in damage to the engine or its intake pipe system.

Thus, there exists a need for an improved apparatus and method for providing compressed gas, such as in a turbocharger, while reducing the occurrence of compressor surge. In some cases, the prevention of compressor surge can expand the useful operating range of the compressor.

BRIEF DESCRIPTION OF THE SEVERAL VIEWS OF THE DRAWINGS

Figure 1:
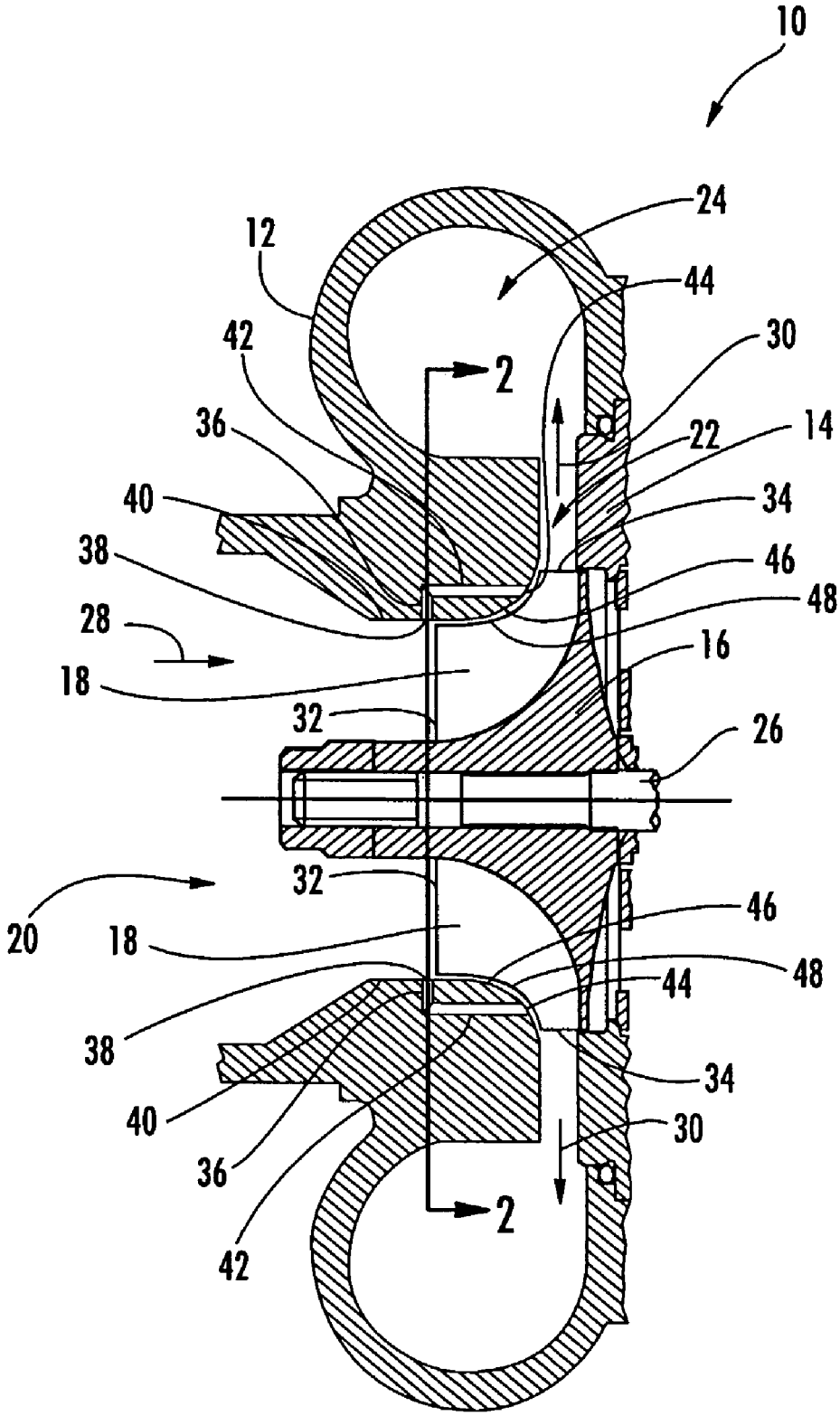
Figure 2:
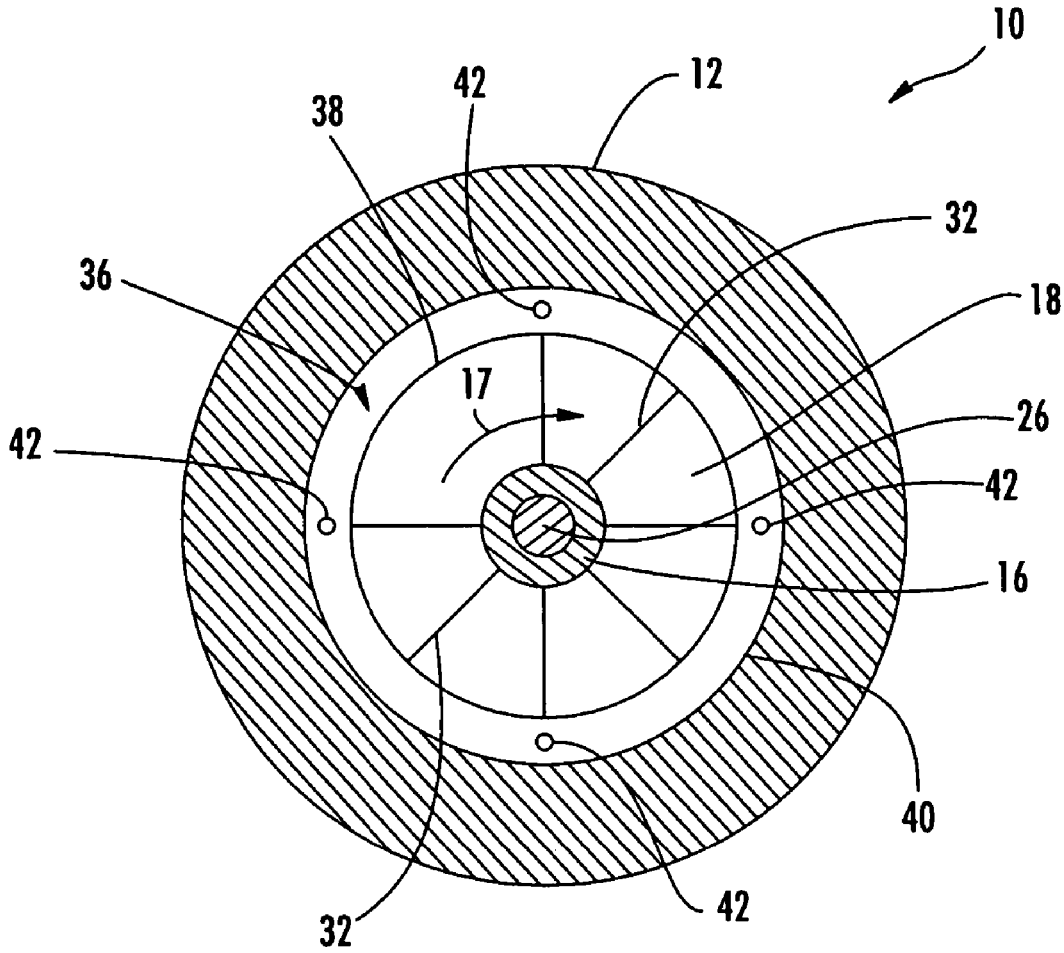
Figure 2A:
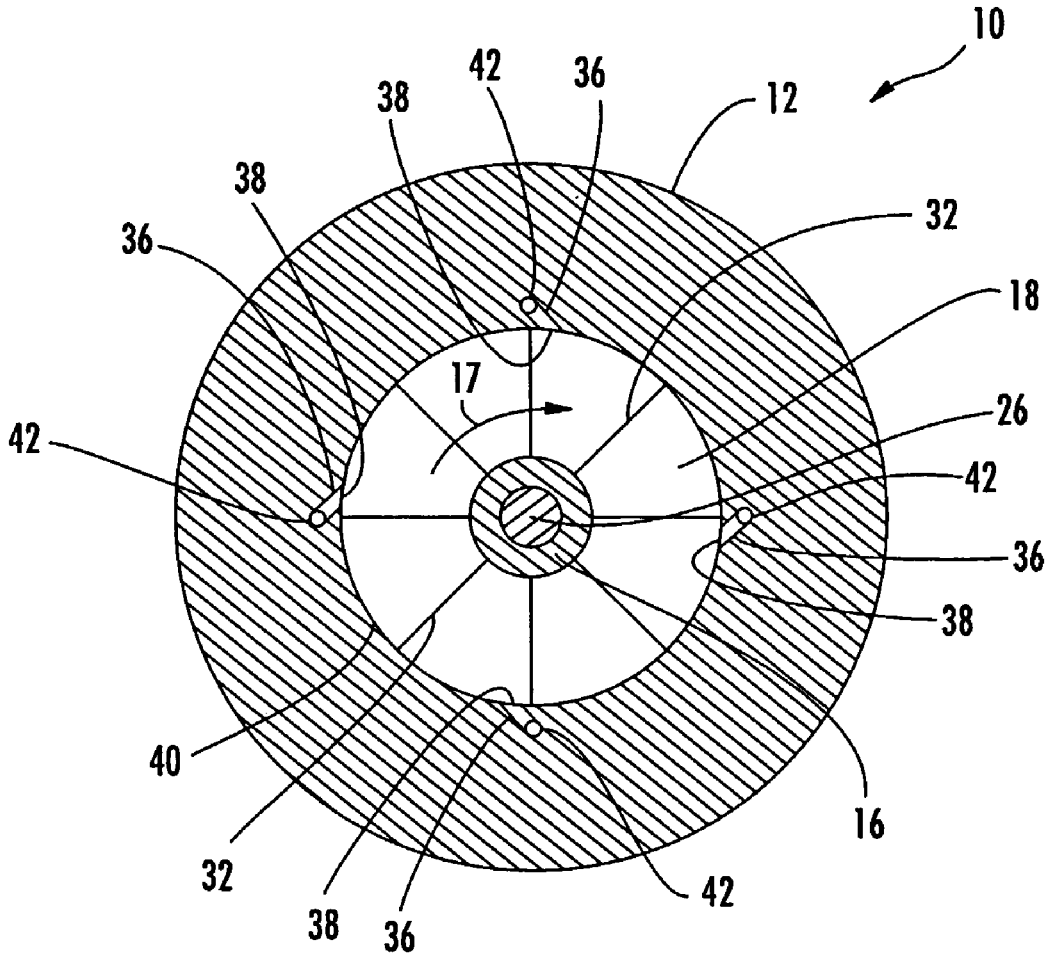
Figure 2B:
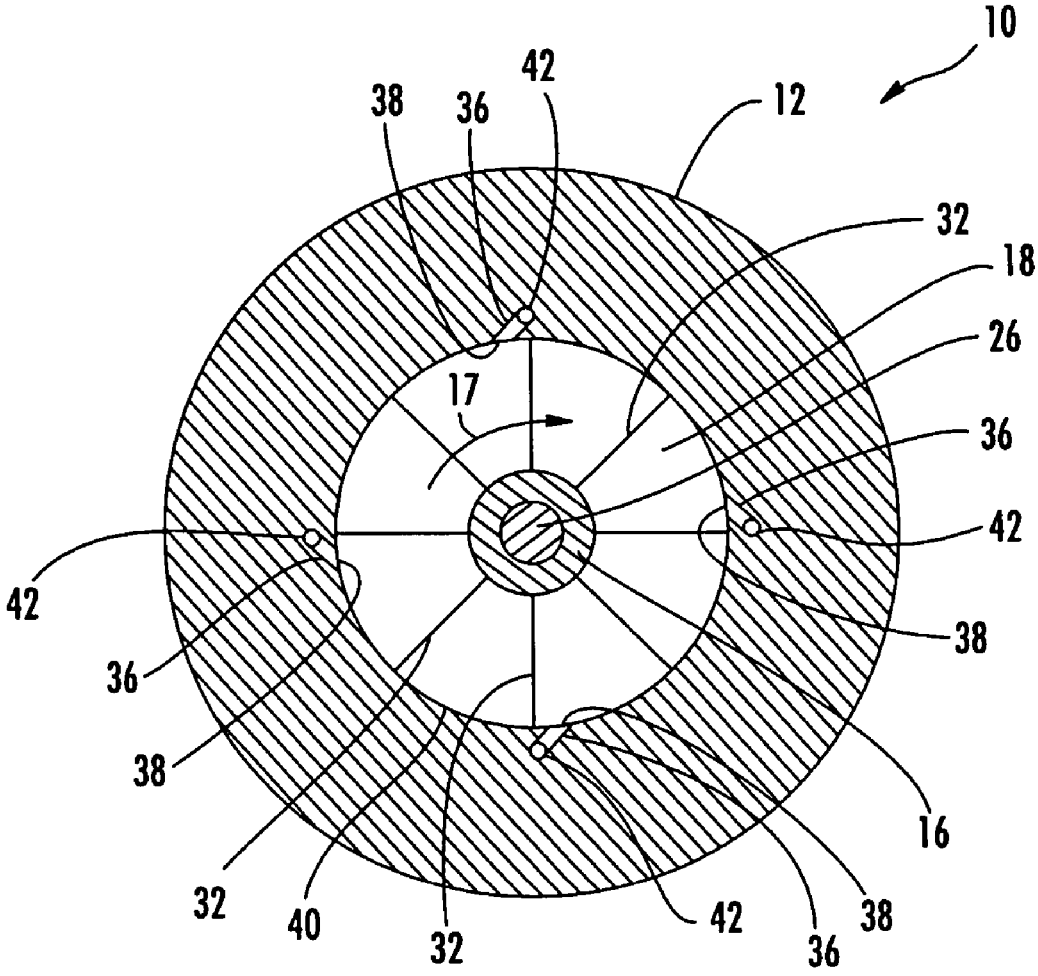
Figure 3:
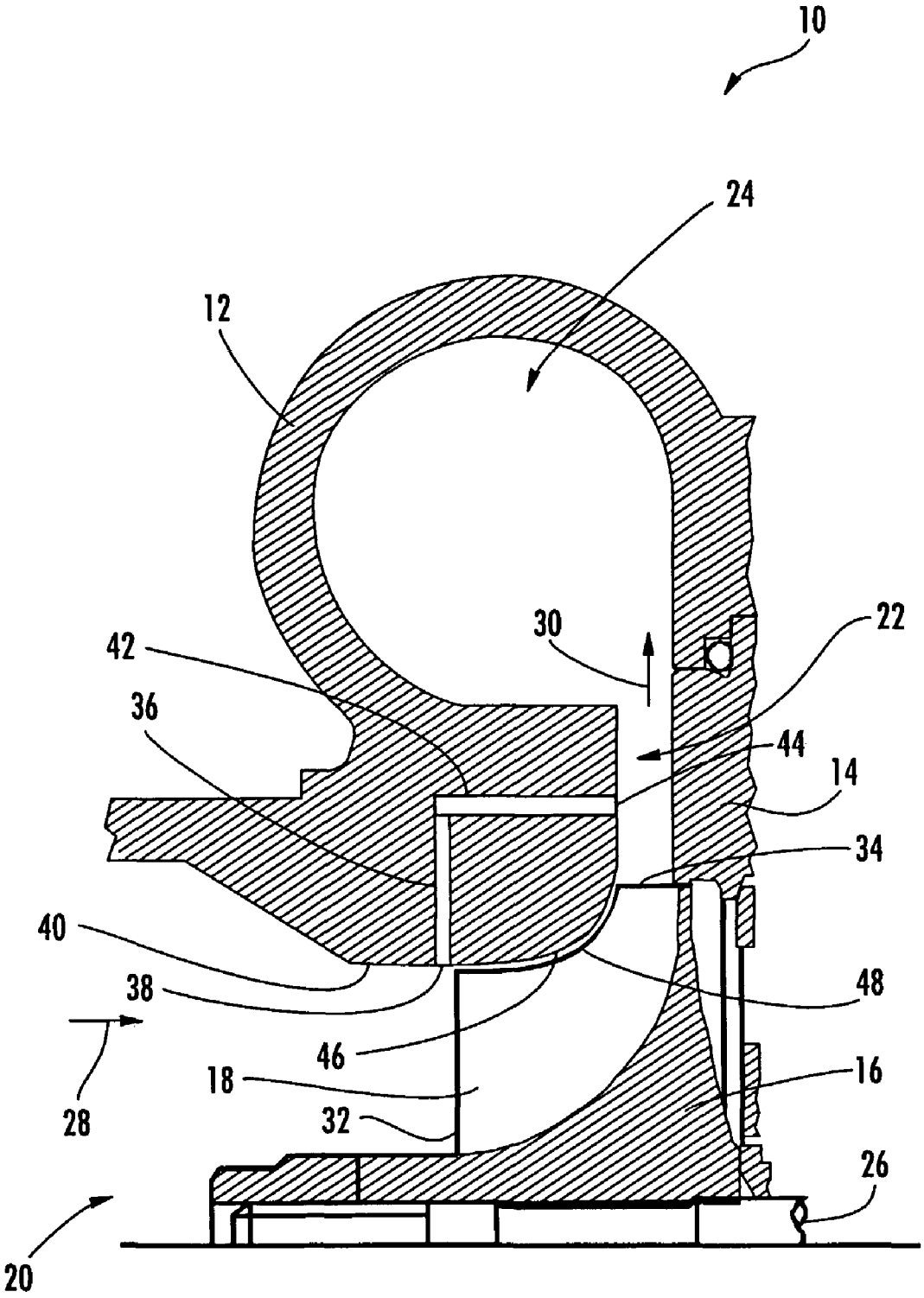
Figure 4:
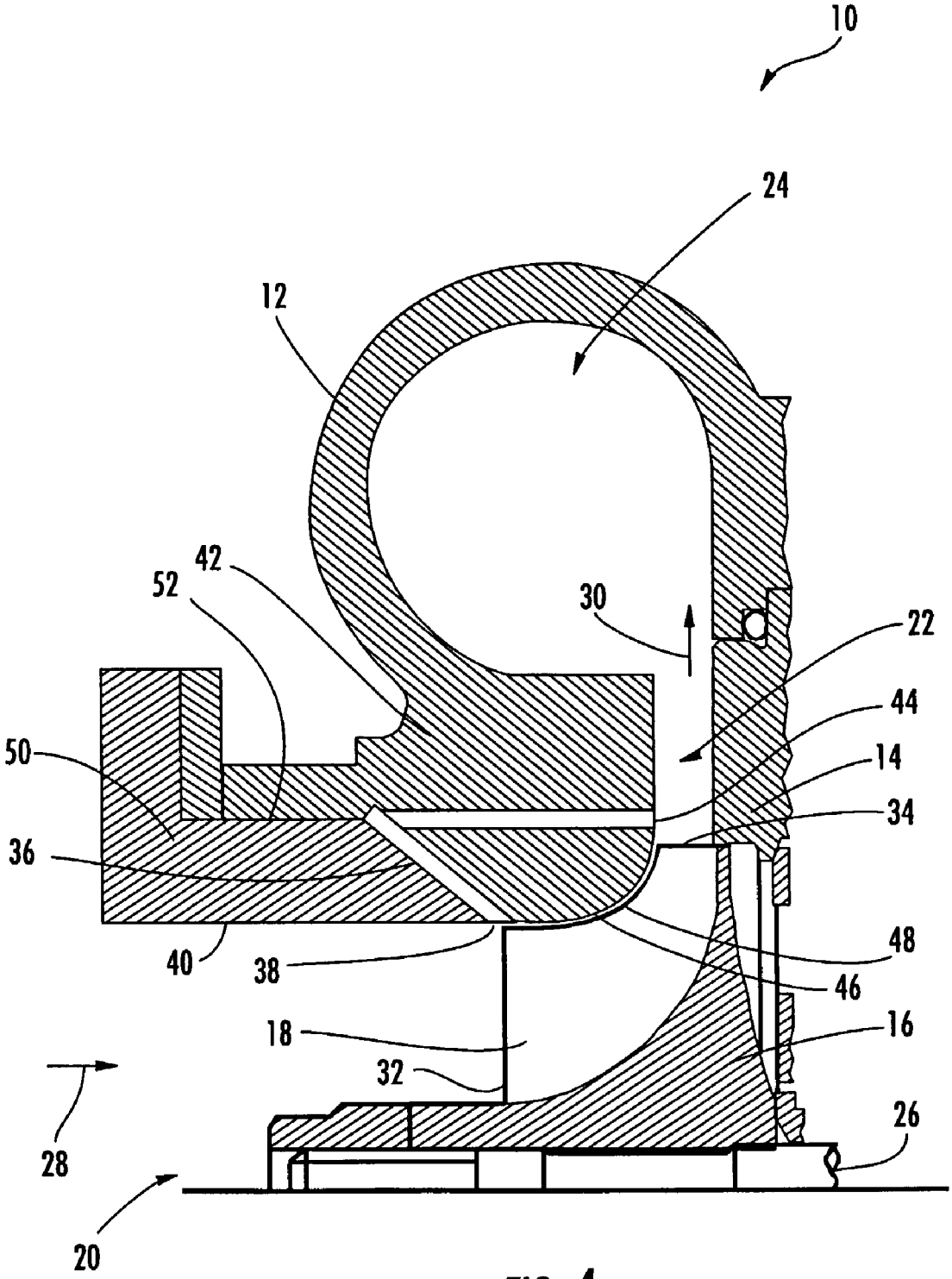
Figure 5:
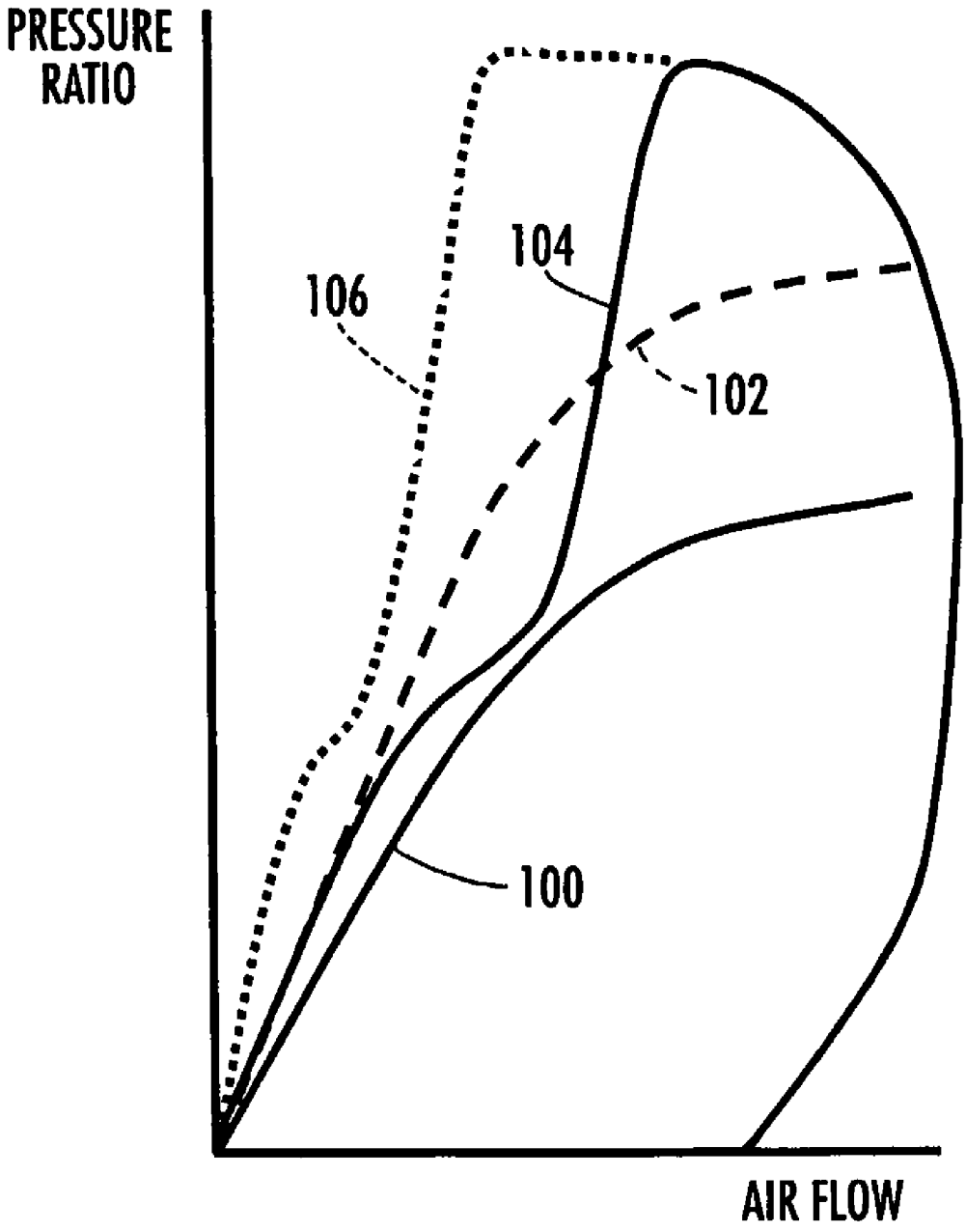

Having thus described the invention in general terms, reference will now be made to the accompanying drawings, which are not necessarily drawn to scale, and wherein:

FIG. 1 is section view in elevation illustrating a compressor of a turbocharger according to one embodiment of the present invention;

FIG. 2 is a section view illustrating the compressor of FIG. 1, as seen along line 2-2 of FIG. 1;

FIGS. 2A and 2B are section views illustrating compressors according to other embodiments of the present invention in which the injection ports are bores;

FIG. 3 is a section view schematically illustrating a compressor of a turbocharger according to yet another embodiment of the present invention in which the fluid channel extends to the diffuser passage;

FIG. 4 is a section view schematically illustrating a compressor of a turbocharger according to still another embodiment of the present invention, in which the injection port defined by the compressor housing defines an angle relative to the axial direction; and FIG. 5 is a graph illustrating the typical operating conditions of a compressor according to one embodiment of the present invention compared to the operating conditions of a conventional compressor.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring now to the figures and, in particular, FIGS. 1 and 2, there is shown a compressor 10 according to one embodiment of the present invention. The compressor 10 can be used in a turbocharger, such as for providing compressed intake air for an internal combustion engine in a vehicle. Alternatively, the compressor 10 can be used in other devices and/or for compressing gases other than air. Thus, while the operation of the compressor 10 is described below as compressing air for use in an internal combustion engine, it is understood that the compressor 10 is not limited to such a function and can be used in various other applications. Further, it is appreciated that the intake air delivered through the compressor 10 can include additional gases, such as exhaust gas that is recirculated from the engine.

As shown in FIG. 1, the compressor 10 includes a housing 12 and a backplate 14. A compressor wheel 16 is rotatably mounted in the housing 12, and blades 18 on the compressor wheel 16 are configured to direct air from an axial inlet passage 20 to a diffuser passage 22 and therethrough to a volute 24. In particular, the compressor wheel 16 is connected to a shaft 26 that extends from the compressor 10, e.g., to connect to a turbine wheel in a turbine housing (not shown) so that the compressor wheel 16 rotates with the turbine wheel. As the compressor wheel 16 rotates in the housing 12, the blades 18 deliver air from the inlet passage 20 to the diffuser passage 22 and volute 24, thereby compressing the air. Thus, air flows into the compressor 10 in a generally axial direction 28 and then through the diffuser passage 22 to the volute 24 in a generally radial direction 30. Each of the blades 18 of the compressor wheel 16 defines a leading edge 32 and a trailing edge 34, and the blades 18 can define a complex three-dimensionally curved contour.

The housing 12 defines one or more injection ports 36 that are configured to receive compressed air from the compressor wheel 16 and recirculate the compressed air to the inlet passage 20. Each injection port 36 defines an outlet 38 on a radially inner surface 40 of the housing 12. For example, each injection port 36 can be fluidly connected to a flow channel 42 that extends between the injection port 36 and an inlet 44 that receives compressed air from the compressor wheel 16, as shown in FIG. 1. Each of the injection ports 36 and the flow channels 42 can be a bore, slot, or other passage defined by the housing 12. For example, as illustrated in FIG. 2, the injection port 36 is a channel or slot that extends circumferentially through the housing 12, and the outlet 38 of the port 36 extends circumferentially on the radially inner surface 40. The flow channels 42 are bores that extend axially from the respective inlet 44 to the injection port 36. Alternatively, as illustrated in FIGS. 2A and 2B, each injection port 36 can be a discrete bore that extends from one of the flow channels 42 to the radially inner surface 40 of the housing 12.

Each injection port 36 and flow channel 42 can define any of various configurations. For example, the inlet 44 of each flow channel 42 can be disposed at a shroud portion 46 of the surface 40 adjacent an edge 48 of the compressor wheel blades 18 between the leading and trailing edges 32, 34. Alternatively, as shown in FIG. 3, the inlets 44 can be disposed in the diffuser passage 22 radially outside the trailing edges 34 of the compressor wheel blades 18.

Each injection port 36 can extend in a radial direction between a respective one of the flow channels 42 and the outlet 38. Alternatively, the injection ports 36 can be configured at an angle relative to the radial direction. For example, as shown in FIGS. 2A and 2B, each injection port 36 is angled circumferentially relative to the radial direction. More particularly, each of the compressor wheels 16 shown in FIGS. 2A and 2B are configured to rotate in a clockwise direction 17, and the injection ports 36 are configured to inject recirculated air with a clockwise component (i.e., a pre-swirl direction) in FIG. 2A or with a counterclockwise component in FIG. 2B (i.e., a counter-swirl direction). In addition, or alternative, each injection port 36 can be disposed at an angle relative to the axial direction, as shown in FIG. 4.

In some cases, the configuration of the injection ports 36 and/or the fluid channels 42 can be configured to facilitate the manufacture of the housing 12. For example, as shown in FIGS. 1 and 3, the housing 12 can be formed as a single unitary member, in which case it may be difficult to access the radially inner surface 40 of the housing 12 with a drilling device to form the injection ports 36 as cylindrical bores. Therefore, forming the injection port 36 as a circumferential channel can facilitate manufacture, as the circumferential channel can be formed with a cutter wheel or other machining tool that can be inserted into the housing 12 and moved radially against the surface 40.

Alternatively, in another embodiment of the present invention, the housing 12 can include multiple body portions that are individually formed and then assembled during manufacture of the compressor 10. In this regard, FIG. 4 illustrates a compressor 10 with a housing 12 having first and second body portions 50, 52, which can be connected by a press fit, bolts or other connectors, weld joints, or the like. Each of the first and second body portions 50, 52 defines at least part of the radially inner surface 40. The first portion 50 can define the injection port 36, and the second body portion 52 can define the flow channel 42. The flow channel 42 can be formed in the first body portion 50 before the two body portions 50, 52 are assembled, i.e., such that a drill or other tool can easily be configured in position to form the injection port 36 with the desired configuration. For example, the injection port 36 can be drilled as a cylindrical bore that extends through the first body portion 50 such that when the body portions 50, 52 are assembled, the injection port 36 extends at an angle relative to the radial direction. The injection port 36 can be angled relative to the axial direction as shown in FIG. 4 and/or the injection port 36 can be angled circumferentially as shown in FIGS. 2A and 2B. Further, if multiple injection ports 36 are provided, the injection ports 36 can be angled similarly or can define different angles relative to the radial and/or axial directions.

The outlet 38 of each injection port 36 is typically disposed proximate to the leading edges 32 of the compressor wheel 16. For example, as illustrated in FIG. 1, each outlet 38 is positioned just upstream of the leading edges 32 of the compressor wheel 16. Thus, compressed air is recirculated through the injection port 36 and delivered to the leading edges 32 of the compressor wheel blades 18. In particular, the compressed air is injected into the inlet passage 20 at a location proximate the radially outermost tips of the leading edges 32 of the blades 18. If the injection ports 36 are angled relative to the axial direction, as illustrated in FIG. 4, the recirculated air can be directed from the outlets 38 directly toward the compressor wheel 16.

In any case, the recirculation of air through the injection ports 36 can reduce the likelihood and occurrence of surging of the compressor 10. Although the present invention is not intended to be limited to any particular theory of operation, it is believed that the provision of recirculated air through the injection ports 36 can increase the axial velocity of the air in the inlet passage 20, thereby reducing the incidence angle of the flow at the leading edges 32 of the blades 18 and thus reducing surging. Further, the recirculation also increases the radial velocity of the flow exiting the compressor 10 into the diffuser passage 22, thereby reducing the likelihood of flow separation along the shroud 46 adjacent the trailing edges 34 of the blades 18 in the diffuser 22. In some cases, the direction of the recirculated flow from the outlets 38 can be designed to also improve the prevention of surging, e.g., by angling the injection ports 36 relative to the axial direction or circumferentially relative to the radial direction.

The recirculation of air through the injection port 36 typically reduces the efficiency of the compressor 10 in at least some modes of operation. Therefore, the compressor 10 can be configured to provide an amount of recirculated air flow that sufficiently reduces the occurrence of surging as required for a particular application, while minimizing the reduction in efficiency. The amount of recirculated air flow can be determined according to the placement of the inlets 44 of the flow channels 42, the operating pressures at the inlets 44 of the flow channels 42 and the outlets 38 of the injection ports 36, the size and configuration of the flow channels 42 and injection ports 36, the number of the flow channels 42 and injection ports 36, and the like. The control of a flow of recirculated air is described in copending International Application No. PCT/US 2004/017819, titled "COMPRESSOR WITH CONTROLLABLE RECIRCULATION AND METHOD THEREFOR," filed concurrently herewith, the entirety of which is incorporated herein by reference.

As described above, the recirculation of air to the inlet passage can reduce surging in the compressor and expand the useful working area of the compressor. FIG. 5 schematically illustrates the typical surging characteristics of a compressor according to one embodiment of the present invention compared to the surging characteristics of a conventional compressor. Lines 100, 102 illustrate the typical pressure ratio (between the air exiting the compressor and the air entering the compressor) and air flow conditions of a compressor without exhaust gas recirculation and a compressor with exhaust gas recirculation, respectively. As illustrated, the operating line 102 indicates that a higher pressure ratio is required to maintain a particular air flow when exhaust gas is recirculated. Line 104 indicates the surge conditions for a conventional compressor, i.e., the pressure ratio above which the compressor is subject to surging. It can be seen that the operating line 102 crosses the surge line 104. Thus, the compressor will be subject to surging at some operating conditions. Alternatively, line 106 illustrates the surge conditions for a compressor according to one embodiment of the present invention. The surge line 106 is shifted relative to the surge line 104 for a conventional compressor. In fact, the operating line 102 does not cross the surge line 106. Thus, the compressors having recirculation of air to the inlet passage according to the present invention can operate throughout a greater range of operating conditions without surging, thereby expanding the operational range of other devices operating in conjunction with the compressor such as a turbocharger and/or an engine.

Many modifications and other embodiments of the invention set forth herein will come to mind to one skilled in the art to which this invention pertains having the benefit of the teachings presented in the foregoing descriptions and the associated drawings. For example, it is appreciated that each of the components of the present invention can be formed of any conventional structural materials including, for example, steels, titanium, aluminum, and other metals. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A centrifugal compressor configured to provide a flow of recirculated air for surge control, the compressor comprising:

a housing defining an axial inlet passage and a radial diffuser passage; and a compressor wheel defining a plurality of blades, each blade having a leading edge adjacent the inlet passage and a trailing edge adjacent the diffuser passage, the compressor wheel rotatably mounted in the housing such that the compressor wheel is configured to receive air flowing generally axially in the inlet passage at the leading edges of the blades and deliver the air from the trailing edges of the blades in a generally radial direction to the diffuser passage, wherein the housing defines at least one injection port configured to receive compressed air from the compressor wheel and recirculate the compressed air to the inlet passage of the compressor, each injection port defining an outlet proximate to the leading edges of the compressor blades, and wherein the housing defines at least one flow channel having an inlet at the diffuser passage, the inlet being configured to receive the compressed air from the diffuser passage, and each flow channel extending in a generally axial direction from the inlet to the at least one injection port such that the injection port delivers the compressed air to the leading edges of the compressor blades.

2. A centrifugal compressor according to claim 1 wherein the housing defines a shroud portion extending proximate to the compressor wheel between the leading and trailing edges of the blades, the housing defining a flow channel having an inlet at the shroud portion and extending from the inlet to a respective injection port.

3. A centrifugal compressor according to claim 1 wherein each injection port extends generally radially inward to the outlet.

4. A centrifugal compressor according to claim 3 wherein the housing defines a plurality of injection ports.

5. A centrifugal compressor according to claim 3 wherein each injection port is angled circumferentially relative to the radial direction for injecting air with a circumferential velocity component into the inlet passage.

6. A centrifugal compressor according to claim 1 wherein each injection port is disposed at an acute angle relative to the axial direction and directed toward the compressor wheel.

7. A centrifugal compressor according to claim 1 wherein each injection port is a bore.

8. A centrifugal compressor according to claim 7, wherein each injection port is arranged such that the circumferential velocity component is in the same direction of the rotation of the compressor wheel.

9. A centrifugal compressor according to claim 7, wherein each injection port is arranged such that the circumferential velocity component is in the opposite direction of the rotation of the compressor wheel.

10. A centrifugal compressor according to claim 1 wherein the injection port is a slot extending circumferentially in the housing.

11. A centrifugal compressor according to claim 1 wherein the housing comprises a unitary body portion defining the at least one injection port and at least partially defining the inlet passage and the diffuser passage.

12. A centrifugal compressor according to claim 1 wherein the housing comprises first and second connected body portions, the first body portion defining the at least one injection port and the second body portion at least partially defining at least one of the group consisting of the inlet passage, the diffuser passage, and a flow channel configured to receive the compressed air from the compressor wheel.

13. A centrifugal compressor according to claim 1 wherein the injection port is configured to inject the compressed air into the inlet passage at a location proximate radially outer tips of the leading edges of the blades.

14. A method for providing a recirculation flow in a compressor, the method comprising:

providing a rotatable compressor wheel in a housing defining an axial inlet passage and a radial diffuser passage;

rotating a compressor wheel having a plurality of blades in the housing such that the compressor wheel receives air flowing generally axially in the inlet passage at leading edges of the blades and delivers the air from trailing edges of the blades in a generally radial direction to the diffuser passage;

receiving compressed air delivered by the compressor wheel; and injecting the compressed air through at least one injection port into the inlet passage of the compressor, wherein:

said receiving step comprises receiving the compressed air into an inlet of at least one flow channel, the inlet being located at the diffuser passage and the at least one flow channel extending from the inlet in a generally axial direction and connecting to the at least one injection port, and said injecting step comprises injecting the compressed air through the at least one injection port into the inlet passage at a position proximate to the leading edges of the blades of the compressor wheel to thereby reduce surging of the compressor, such that the compressed air is recirculated from the diffuser passage to the leading edges of the compressor blades.

15. A method according to claim 14 wherein said injecting step comprises injecting the compressed air in a generally radial direction.

16. A method according to claim 15 wherein said injecting step comprises injecting the compressed air through a plurality of bores constituting a plurality of injection ports.

17. A method according to claim 15 wherein said injecting step comprises injecting the compressed air in a direction angled circumferentially relative to the radial direction.

18. A method according to claim 14 wherein said injecting step comprises injecting the compressed air at an acute angle relative to the axial direction and directed toward the compressor wheel.

19. A method according to claim 14 wherein said injecting step comprises injecting the compressed air through at least one bore constituting the at least one injection port.

20. A method according to claim 14 wherein said injecting step comprises injecting the compressed air through the at least one injection port constituted by a slot extending circumferentially in the housing.

21. A method according to claim 14 wherein said providing step comprises forming a unitary body portion defining the at least one injection port and at least partially defining the inlet passage and the diffuser passage.

22. A method according to claim 14 wherein said providing step comprises forming and connecting first and second body portions, the first body portion defining the at least one injection port and the second body portion at least partially defining at least one of the group consisting of the inlet passage, the diffuser passage, and the flow channel configured to receive the compressed air from the compressor wheel.

23. A method according to claim 14 wherein said injecting step comprises injecting the compressed air into the inlet passage at a location proximate radially outer tips of the leading edges of the blades.

* * * * *